US007644907B2

(12) United States Patent
Ives et al.

(10) Patent No.: US 7,644,907 B2
(45) Date of Patent: Jan. 12, 2010

(54) DRUM FOR A WELL ACCESS LINE

(75) Inventors: Sebastien Ives, Airaines (FR); Emma Ford, Sugar Land, TX (US); Baptiste Germond, Drucat (FR); Pierre-Yves Corre, Eu (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/047,849

(22) Filed: Mar. 13, 2008

(65) Prior Publication Data

US 2008/0185139 A1 Aug. 7, 2008

Related U.S. Application Data

(63) Continuation-in-part of application No. 11/617,341, filed on Dec. 28, 2006.

(51) Int. Cl.
*B21F 9/00* (2006.01)

(52) U.S. Cl. ..... 254/278; 254/214; 242/613

(58) Field of Classification Search ..... 254/214, 254/215, 278, 371, 372; 242/407, 614, 614.1, 242/118.4, 602, 603, 322, 612, 613, 609
See application file for complete search history.

(56) References Cited

U.S. PATENT DOCUMENTS

| | | | | |
|---|---|---|---|---|
| 1,404,934 | A | 1/1922 | Cunningham | |
| 1,822,422 | A | 9/1931 | Richardson | |
| 1,822,474 | A * | 9/1931 | Bureau | 242/608.4 |
| 1,962,086 | A * | 6/1934 | Bixby | 242/612 |
| 1,984,604 | A | 12/1934 | Stahl | |
| 2,299,532 | A * | 10/1942 | Cronk et al. | 242/587.2 |
| 2,420,050 | A | 5/1947 | Maude | |
| 2,587,707 | A * | 3/1952 | Dever | 242/388 |
| 2,805,290 | A * | 9/1957 | Wentsel | 191/12.4 |
| 2,892,598 | A | 6/1959 | Dudley | |
| 2,944,756 | A | 7/1960 | Wilson | |
| 3,266,748 | A | 8/1966 | Le Bus, Sr. | |
| 3,323,743 | A * | 6/1967 | Landgraf | 242/586.2 |
| 3,391,443 | A | 7/1968 | Le Bus, Sr. | |
| 3,610,549 | A | 10/1971 | Wennerstrom et al. | |
| 3,633,843 | A * | 1/1972 | Sutton | 242/397 |
| 3,717,315 | A | 2/1973 | Kovaleski | |
| 3,850,380 | A | 11/1974 | Kranefeld | |
| 4,269,371 | A | 5/1981 | Kovaleski | |
| 4,602,751 | A | 7/1986 | Vogel | |
| 5,322,233 | A * | 6/1994 | Hehner et al. | 242/596 |
| 5,330,127 | A | 7/1994 | Hafner | |

(Continued)

FOREIGN PATENT DOCUMENTS

| | | |
|---|---|---|
| DD | 127204 | 9/1977 |

(Continued)

*Primary Examiner*—Emmanuel M Marcelo
(74) *Attorney, Agent, or Firm*—Michael Flynn; David Cate; Jaime Castano

(57) ABSTRACT

A drum assembly for accommodating a well access line. The drum of the assembly may include a core coupled to flanges at either side thereof. The core may be configured to accommodate the well access line thereabout. Additionally, the core may be configured with an inner portion for coupling to the flanges at an arcuate junction therebetween as well as a collar about the inner portion for directly accommodating the well access line in a stable manner.

15 Claims, 5 Drawing Sheets

U.S. PATENT DOCUMENTS

| | | | | |
|---|---|---|---|---|
| 5,474,254 | A | 12/1995 | Faulkner | |
| 5,613,648 | A * | 3/1997 | Paavila | 242/405.2 |
| 5,975,455 | A * | 11/1999 | Alegre | 242/396.4 |
| 6,701,113 | B2 | 3/2004 | Matsuda et al. | |
| 6,916,045 | B2 | 7/2005 | Clancy, III et al. | |
| 6,980,709 | B2 | 12/2005 | Carlson et al. | |
| 2003/0085391 | A1 | 5/2003 | Noske | |
| 2005/0092281 | A1 | 5/2005 | Choi | |
| 2006/0273213 | A1 | 12/2006 | Turk et al. | |

FOREIGN PATENT DOCUMENTS

| | | | |
|---|---|---|---|
| DE | 10224481 | A1 | 1/2004 |
| EP | 1178007 | A1 | 2/2002 |
| JP | 58067890 | | 5/1983 |
| JP | 58119595 | | 7/1983 |
| JP | 58216892 | | 12/1983 |
| JP | 62017240 | A | 1/1987 |
| JP | 62024868 | A | 2/1987 |
| JP | 543193 | A | 2/1993 |
| JP | 61009559 | A | 9/1994 |
| JP | 2005140322 | A | 6/2005 |
| RU | 2205148 | C2 | 5/2003 |
| WO | 0144088 | | 6/2001 |

* cited by examiner

DRUM FOR A WELL ACCESS LINE

CROSS REFERENCE TO RELATED APPLICATION

This Patent Document is a continuation-in-part claiming priority under 35 U.S.C. § 120 to U.S. application Ser. No. 11/617,341 entitled High Load Flange Profile for a Wireline Drums, filed on Dec. 28, 2006, incorporated herein by reference in its entirety.

FIELD

Embodiments described relate to drums for accommodating well access lines, often referred to as winch drums. In particular, drums are disclosed of novel configuration for withstanding increased stress concentration from well access lines employed in ever deeper and more tortuous well operations.

BACKGROUND

Exploring, drilling and completing hydrocarbon and other wells are generally complicated, time consuming and ultimately very expensive endeavors. As such, tremendous emphasis is often placed on well access in the hydrocarbon recovery industry. That is, access to a well at an oilfield for monitoring its condition and maintaining its proper health is of great importance in the industry. As described below, such access to the well is generally provided by a well access line accommodated by a drum positioned at the oilfield.

During monitoring and maintaining of a well, a host of oilfield equipment may be located at the oilfield near the well. As indicated, one such piece of equipment may be a drum assembly accommodating a well access line. The well access line itself may be a coiled tubing line capable of delivering a fluid therethrough and to the well. Alternatively, the line may be a wireline configured to deliver a well tool downhole into the well. In the case of coiled tubing, the line may be threaded through an injector arm and into the well, whereas a more conventional wireline may be dropped into the well from a mast over the well. Regardless, several thousand feet of well access line may be accommodated at the drum for delivery into the well, thereby providing well access for a variety of well monitoring and maintenance procedures.

In the case of wireline procedures, several thousand feet of wireline cable may be provided to the oilfield wrapped about the drum assembly. In many cases wireline access to the well proceeds with a logging tool coupled to the wireline and dropped into the well. With the tool positioned downhole, the cable is then pulled uphole by the drum assembly as the logging application proceeds, recording information relative to the well and surrounding formation. In this manner a log revealing an overall profile of the well may be established, with measurements being recorded continuously as a function of depth in the well.

Similarly, a coiled tubing application may proceed with several thousand feet of coiled tubing provided to the oilfield by way of a drum assembly. The coiled tubing may be threaded through a gooseneck arm and injector for driving of the coiled tubing into the well in order to perform an operation within the well. For example, the coiled tubing may be employed in a clean out operation. That is, the coiled tubing may be equipped with a spray tool and directed to an area of accumulated debris within the well. In this manner a fluid may be pumped through the coiled tubing in order to clean out the debris within the well. The coiled tubing may then be pulled uphole and out of the well for subsequent well operations.

Regardless of the particular type of well access line or procedure, such as those noted above, the drum assembly is subjected to a significant amount of strain and tension from the load placed thereon by the line. For example, the withdrawal alone of the well access line from the well places a significant amount of stress on the drum. That is, tension is exerted on the drum during this pulling as a result of the weight of the line and any tools disposed thereon. Additional tension is also exerted on the drum as a result of the friction of the line and the tool being dragged up against the well wall. Furthermore, there may be a significant amount of fluid resistance to the tool being removed, especially at any high rate of speed. The cumulative effects of such tension may lead to plastifying of the drum in particular locations, eventually leaving the drum ineffective for proper use in well access operations. The drum is particularly susceptible to plastifying of this nature at a junction of its core, about which the line is wrapped, and the wall-like flanges at the sides of the core which help to retain the line in position about the core. Unfortunately, once rendered ineffective in this manner, the drum may be replaced at a cost that may be in excess of $80,000 or more.

Furthermore, the frequency of drum replacement for well access operations has risen sharply in the last several years and is likely to continue rising. This is a result of the types of wells which are becoming more and more common. That is, in today's hydrocarbon recovery industry, highly deviated and tortuous wells are becoming more and more common along with deeper and deeper wells. As a result, the tension of the line on the drum is increased due to the added amount of friction and fluid resistance that accompany such wells as well as the added weight of the longer line, perhaps 30,000 feet or longer. Indeed, the life expectancy of a conventional drum regularly employed in such high tension operations is significantly reduced and to date, no significant drum assembly modifications have been implemented to materially alter this fact.

SUMMARY

A drum for providing a well access line at an oilfield is disclosed. The drum includes an inner core and at least one flange integrally coupled thereto at a junction of the core and the flange. The junction may be of an arcuate configuration for reducing stress concentration thereat. Additionally, a collar is provided about the core for accommodating the well access line thereabout. However, this collar may be structurally independent of the flange.

DETAILED DESCRIPTION

Embodiments are described with reference to certain drums and well access operations. As such, certain configurations of drums are depicted and described. For example, the embodiments describe particular wireline applications in which the drum is configured for accommodating wireline with a well tool disposed at the downhole end thereof. However, a variety of other oilfield applications may take advantage of drum embodiments described herein. For example, the well access line may be coiled tubing for delivering a fluid to a well at the oilfield. Regardless, embodiments described herein include a drum that is configured to accommodate a well access line imparting increased tension on the drum. Such drums may be particularly advantageous for oilfield applications directed at deeper or more tortuous wells.

Figure 1:
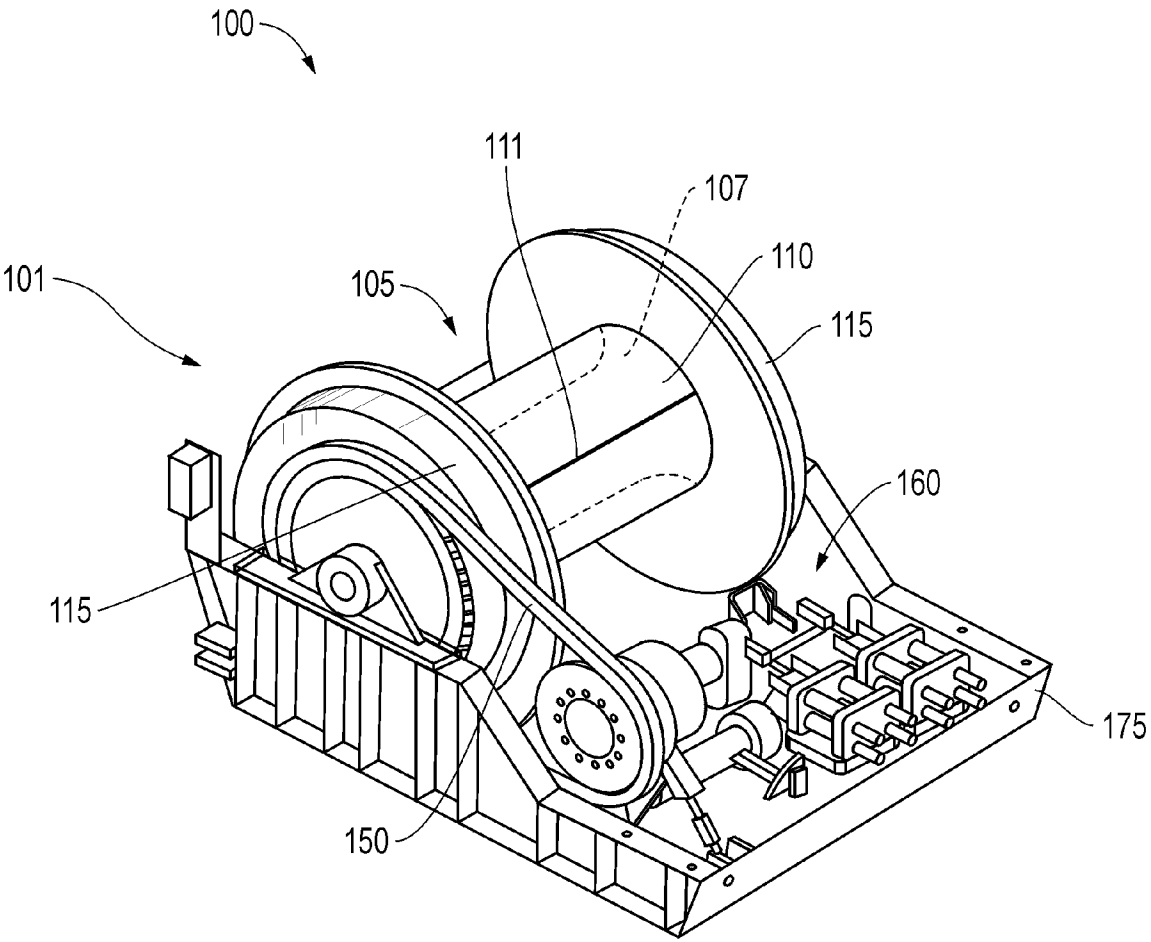
FIG. 1 is a perspective view of an embodiment of a drum as part of a drum assembly.
Figure 3:
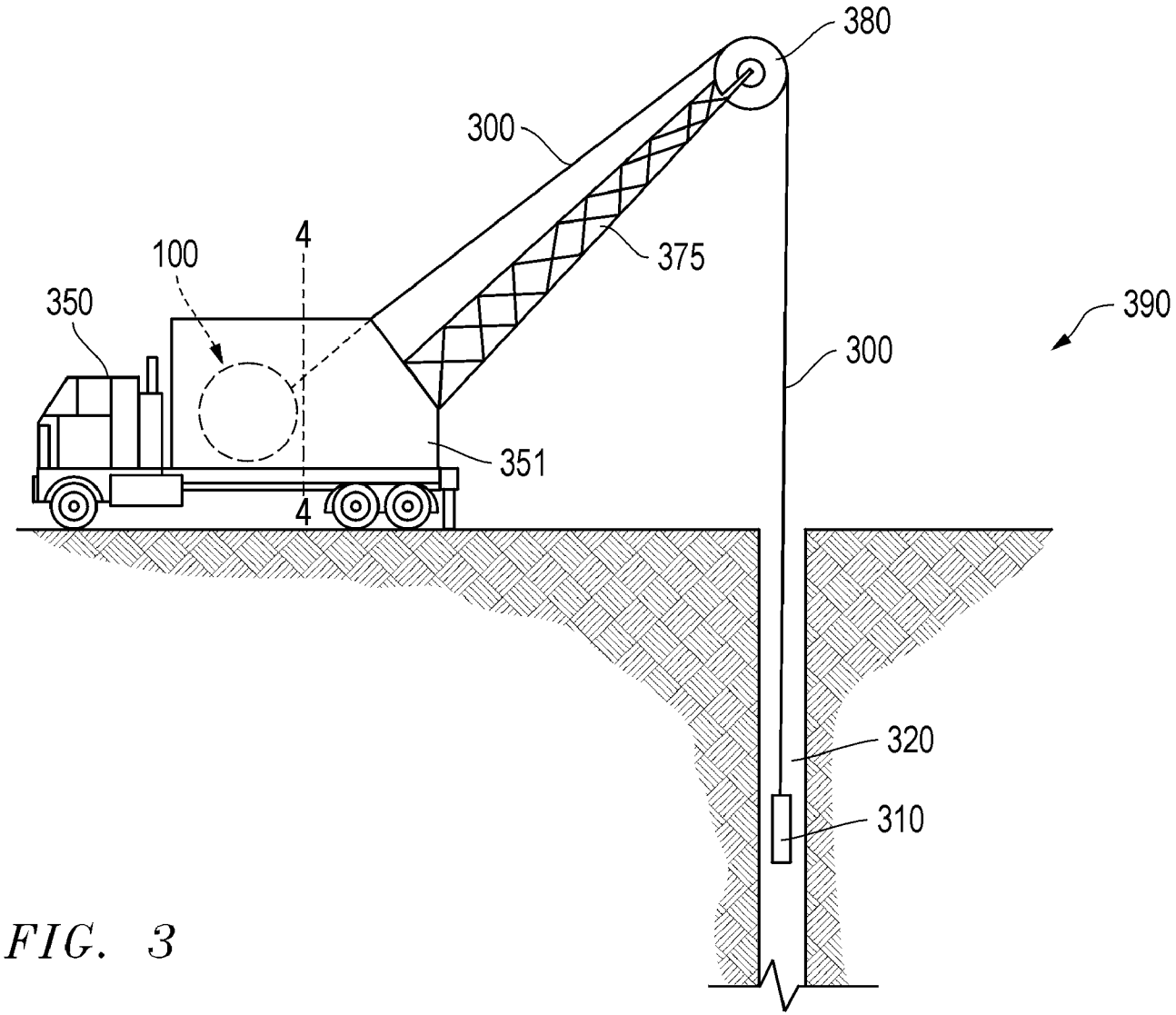
FIG. 3 is a side overview of a drum truck accommodating the drum assembly of FIG. 1 and employed for accessing a well at an oilfield with a well access line.

Referring now to FIG. 1, with added reference to FIG. 3, an embodiment of a drum assembly 100 is depicted. The drum assembly includes a drum 101 that is driven by a prime mover 160, both of which are accommodated at a skid 175 to provide a degree of mobility to the assembly 100. The drum 101 includes a core 105 for accommodating a well access line 300 thereabout as well as flanges 115 on either side thereof in order to ensure retention of the line 300. As detailed further below, the configuration of the core 105 is such that damage to drum 101 over time may be reduced even in the face of repeated high tension operations in which the well access line 300 imparts significant amounts of concentrated stress to particular locations of the drum 101.

Figure 2:
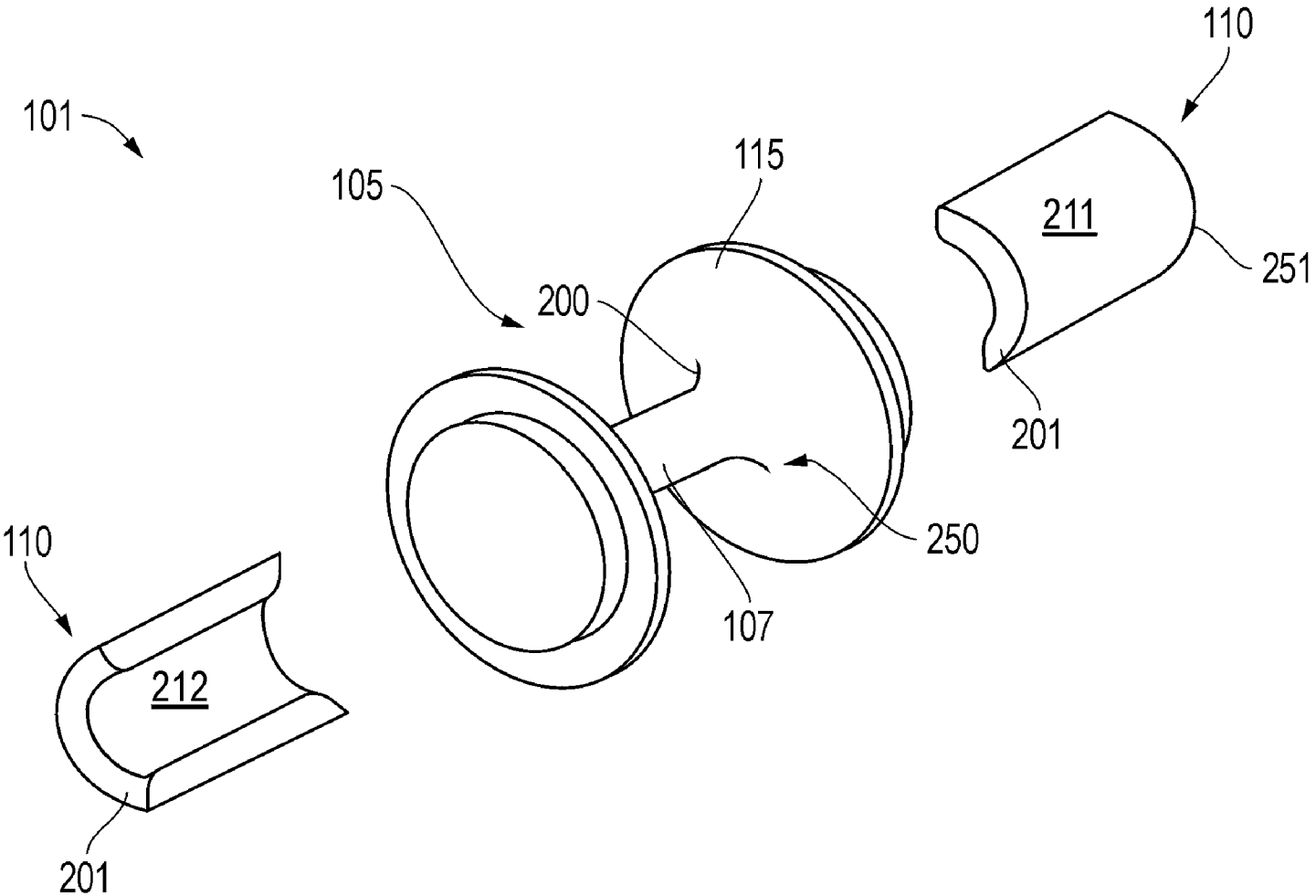
FIG. 2 is an exploded perspective view of the drum of FIG. 1.

Continuing with reference to FIG. 1, with added reference to FIG. 2, the core 105 of the drum 101 is made up of an inner core 107 with a collar 110 thereabout. The collar 110 itself is made up of collar sections 211, 212 which join about the inner core 107 while maintaining a degree of structural independence therefrom (as well as from the flanges 115). A seam 111 from the joining of these sections 211, 212 is apparent at the front of the core 105 as depicted in FIG. 1. It is this configuration of the core 105 which provides improved resistance to plastifying in the face of high tension and concentrated stress as alluded to above and detailed further below. Additionally, of note is the fact that the outer diameter of the collar 110 may be of standard core sizing, for example, about 24 inches, so as to allow the drum 101 to be employed with a conventional assembly 100 without substantial modification.

With added reference to FIG. 3, flanges 115 abut either side of the core 105 such that a well access line 300 may be wrapped around the core 105 and retained thereat. In the embodiment of FIG. 1, one of the flanges 115 is coupled to a prime mover 160 through a drive belt 150. In this manner, the belt 150 may be employed to rotate the drum 101 for wrapping the well access line 300 about the core 105, or alternatively releasing wrapped line 300 from about the core 105, for example, into a well 320. Depending on the nature of the operations, as many as 30 layers or more of the line 300 may be wrapped about the core 105 at a given time. Furthermore, in the embodiment shown, the drum assembly 100 is provided on a skid 175 for ease of transport as a unit to and from an oilfield 390, for example, as part of a drum truck 350 as shown in FIG. 3.

Referring now to FIGS. 1-3, the drum 105 is configured so as to include plastifying resistance as described above is detailed further. With particular reference to FIG. 2, an exploded view of the drum 101 reveals the distinct portions of the drum 105. Namely, in the embodiment shown, the inner core 107 and the flanges 115 are of a unitary or monolithic configuration, often of a high manganese steel material. Collar sections 211, 212, generally of the same material may be separately provided about the inner core 107.

As described above, when the core 105 is accommodating a well access line 300 as depicted in FIG. 3, extreme amounts of tension may be imparted upon the drum 101. In particular, the area around the junction between the core 105 and a flange 115, referred to herein as the core-flange junction 250, may be subjected to a concentration of stress from the tension imparted by the line 300 (see FIG. 3). For example, layers of wound line 300 may impart forces radially inward on the core 105 and simultaneously in an axial manner outward toward the flanges 115. Forces exerted on the core 105 and flanges 115 may increase cumulatively with each added layer of well access line 300. Thus, in one embodiment, with a line 300 of between about 30,000 and about 40,000 feet or more, perhaps over 30 layers may be accommodated by the drum 101 even prior to deployment into a well 320 as shown in FIG. 3. However, as indicated, the configuration of the drum 101 in the embodiment shown provides plastifying resistance at the area near the core-flange junction 250 so as to prolong the life of the drum 101.

Separation of the inner core 107 from a flange 115 at the core-flange junction 250 due to stress concentration from a line 300 as shown in FIG. 3 would be a particular example of plastifying. However, a certain degree of resistance to plastifying of this type is provided by the enhanced structural integrity offered by the monolithic or unitary nature of the inner core 107 and the flanges 115 relative to one another as noted above. That is, the core-flange junction 250 is devoid of any seam or other feature susceptible to separation or plastifying as described. However, in the embodiment shown, the core 105 is configured with additional features providing added resistance to plastifying. For example, rather than bluntly terminating at the flanges 115, the inner core 107 tapers out from its midsection in meeting up with the flanges 115. This tapering out can be seen as a radius or arcuate portion 200 where the inner core 107 and the flanges 115 come together. In this manner the potential concentration of stress imparted at the core-flange junction 250 may be spread out a bit toward the inner core 107. Thus, additional resistance to plastifying may be provided.

In addition to plastifying resistance as provided by the arcuate portion 200, the core 105 is equipped with a collar 110 as described above. Thus, with added reference to FIGS. 3 and 4, a well access line 300 may be wrapped about the core 105 without actually contacting the inner core 107 thereof. For example, in the embodiment shown in FIG. 4, the collar 110 meets up with the flanges 115 at each side of the core 105 so as to form a substantially right angle at about the core-flange junction 250. As a result, the well access line 300 may be wrapped about the collar 105 and retained by the flanges 115 in a stable manner. That is, no portion of the line 300 is forcibly wound about the surface of the arcuate portion 200 in an unstable fashion. Rather, the well access line 300 may be controllably accommodated about the drum 101 for releasing into the well 320 or withdrawing therefrom.

Continuing with reference to FIG. 2 the drum 101 is made up of the monolithic and unitary inner core 107 and flanges 115 surrounded by the collar 110 as described above. In the embodiment shown, the collar 110 is provided in the form of two separate collar sections 211, 212. However, in other embodiments the collar 110 may be made up of more than two such sections. Additionally, the sections 211, 212 depicted in FIG. 2 may be provided with arcuate outer edges 201 for physically conforming to the arcuate portion 200 of the inner core 107 therebelow. Ultimately, a high tension drum 101 is provided with line stress on the core 105 imparted on the collar 110, whereas line stress on the flange-core junction 250 is distributed across the arcuate portion 200. In this manner, stress concentration at any one particular location from a well access line 300 as depicted in FIG. 3 may be substantially reduced.

Referring now to FIG. 3, the drum 101 and assembly 100 of FIGS. 1 and 2 are depicted in a well access operation at an oilfield 390. In particular, the well access line 300 shown is in the form of a wireline cable for a logging operation. However, other embodiments of drums 101 and assemblies 100 may be employed in other types of well access operations. For example, a high tension drum 101 and assembly 100 according to embodiments detailed herein may be employed for a coiled tubing operation where the well access line 300 is in the form of coiled tubing for delivering a fluid downhole.

Continuing with reference to FIG. 3, the drum assembly 100 is provided to the oilfield 390 by way of a drum truck 350. The truck 350 includes a trailer housing 351 equipped with a mast 375 having a pulley 380 at the top thereof for positioning over a well 320. From here, the well access line 300 may be employed to position a logging tool 310 in the well 320. For example, several thousand feet of well access line 300 may be dropped into the vertical well 320 from the position shown. From a downhole position, the line 300 and tool 310 may then be pulled uphole by the drum assembly 100. In this manner the tool 310 may be employed in a conventional logging procedure, recording information relative to the well and surrounding formation. As such, an overall profile of the well 320 may be established with measurements recorded continuously as a function of well depth.

For the logging application described above, a significant amount of strain and tension may be placed on the assembly 100 by the well access line 300. This strain may be quite significant given the potentially extensive length of the line 300 and depth of the well 320 as is becoming more common in the hydrocarbon recovery industry. Furthermore, strain may be magnified as the logging tool 310 is pulled back uphole due to factors such as the friction of the line 300 and tool 310 against the wall of the well 320 along with fluid resistance to the uphole movement.

Figure 4:
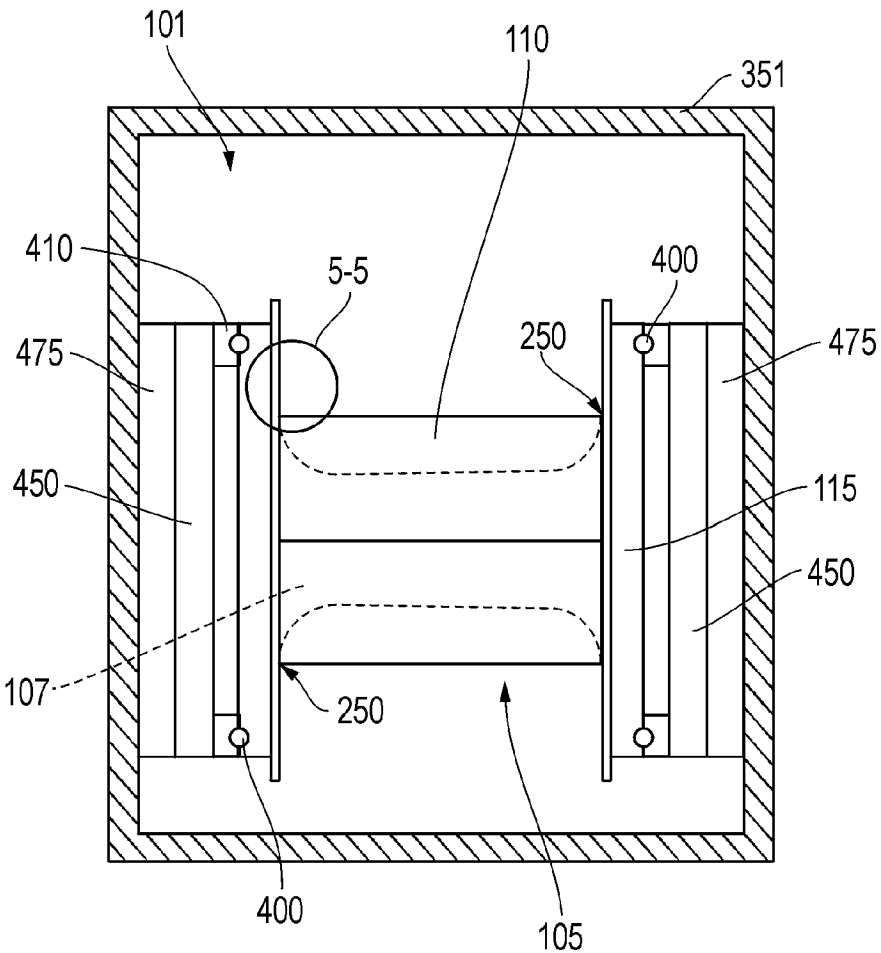
FIG. 4 is a side cross sectional view of the drum truck taken from 4-4 of FIG. 3.

Continuing with reference to FIGS. 3 and 4, as a result of the potentially dramatic increase in strain on the drum assembly 100, locations of stress concentration on the drum 101 may be present. As indicated above, the core-flange junction 250 may be such a location stress concentration. Nevertheless, due to the configuration of the drum 101 as detailed above, the possibility of plastifying at the core-flange junction 250 may be substantially reduced thereby extending the life of the drum 101 even in the face of such repeated high tension applications.

With particular reference to FIG. 4, a cross-sectional view of the drum truck 350 taken from the trailer housing 351 at 4-4 of FIG. 3 is depicted. For ease of illustration, the well access line 300 of FIG. 3 is not depicted in FIG. 4. However, as indicated above with added reference to FIG. 3, stress concentration from the line 300 is likely to be found at the core-flange junction 250. In FIG. 4, the core-flange junction 250 is readily visible as a substantially right angle. The core 105 of the drum 101 is shown with the external collar 110 for properly accommodating the well access line 300, while an underlying inner core 107 is provided to help reduce the effects of stress brought about by the load of the line 300. Additionally, as detailed further below, features adjacent the drum 101 may be provided for reinforcement of the flanges 115, providing additional plastifying resistance.

The drum 101 is positioned between walls of the trailer housing 351 as depicted in FIG. 4. As such, the flanges 115 of the drum 101 may be reinforced by coupling thereof to the walls of the trailer housing 351. For example, a spacer 475 and bearing plate 450 may be coupled to each wall of the trailer housing 351 in order to accommodate bearing housings 410 adjacent each flange 115. Thus, each flange 115 may be supported from each side of the drum 101, providing a measure of stability in light of stress concentration found at the core-flange junction 250. Bearings 400 within the housings 410 may interface a groove within the flanges 115 to allow for rotation of the drum 101 when advancing or retracting a well access line 300 as depicted in FIG. 3. With appropriate sizing and spacing of supportive features between each flange 115 and its adjacent trailer wall, a substantial amount of flange reinforcement may be provided. Thus, the amount of plastifying resistance provided to the drum 101 may be substantially increased.

Figure 5:
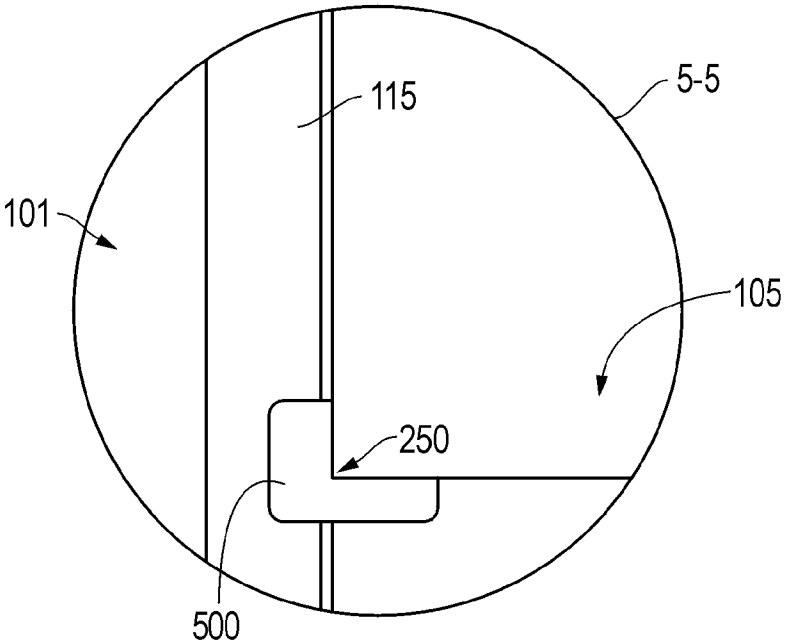
FIG. 5 is an enlarged view of a core-flange junction of the drum taken from 5-5 of FIG. 4.

Continuing now with reference to FIG. 5, an enlarged view of a portion of the drum 101 taken from 5-5 of FIG. 4 is shown. Of note, is the fact that the drum 101 is equipped with added plastifying resistance by the inclusion of a ductile material insert 500. As shown, the insert 500 may be provided within a groove that is contiguous between the core 105 and adjacent flange 115 at the core-flange junction 250. In one embodiment the groove and insert 500 may be about 4 inches by about 4 inches, dimensionally. However, other sizing may also be employed.

The ductile material insert 500 may be of a material that is of a higher fatigue life than the material of the adjacent core 105 and flange 115. Nevertheless, the insert 500 may be configured to be removable and replaceable due to its location at the core-flange junction 250. That is, regardless of the particular hardness, lifespan, or other characteristics of the ductile material insert 500, the removable nature thereof may allow for continued use of the drum 101 with a subsequent insert so long as replaced in advance of plastifying of portions of the neighboring core 105 and flange 115.

Figure 6:
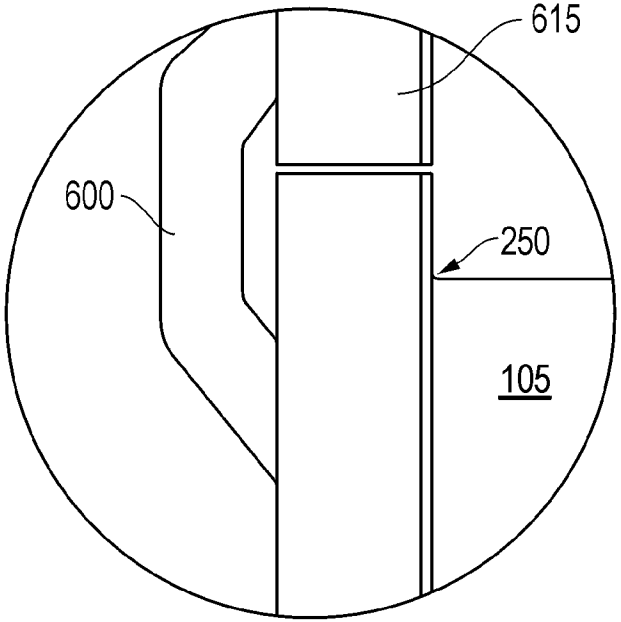
FIG. 6 is an alternate embodiment of the core-flange junction of FIG. 5 employing a divided flange.

Referring now to FIG. 6, an alternate embodiment of the drum 101 is depicted where the plastifying resistance is added to the core-flange junction 250 through employment of a split flange 615. That is, rather than employing a core 105 and flange 115 of unitary construction as depicted in FIGS. 1-5, the flange 615 of FIG. 6 is split above the core-flange junction 250. In this embodiment, a lower portion of the flange 615 is coupled directly to the core 105 as described hereinabove. However, a separate flange arm 600 is provided coupling of the upper portion of the flange 615 back to the core 105. In this manner, stress on the flange 615 from retained well access line 300 as shown in FIG. 3 may be spread out over the surface of separate upper and lower portions of the flange 615. As such, a certain portion of stress may be distributed across the flange arm 600 and back toward the core 105.

In the embodiment of FIG. 6, stress concentration right at the core-flange junction is also reduced by the employment of a split flange 615. Indeed, the split in the flange 615 may be moved to a location right at the core-flange junction 250 effectively eliminating the physical structure of the junction altogether, thus, also eliminating its susceptibility to plastifying damage. In such an embodiment, line stress may be accommodated exclusively by the flange 115 and its arm 600. However, the effects of stress concentration at the core-flange junction 250 itself may be substantially eliminated.

Embodiments described hereinabove provide a drum assembly of improved plastifying resistance. This is achieved in light of significant load placed on the drum, in particular, at a core-flange junction thereof. The load may be from the accommodating of up to 30 or more layers of well access line about a core of the drum as well as from withdrawal of the line from a well, including where the withdrawal is from an extended reach well or one of a particularly tortuous or deviated configuration. As a result, the life of the drum may be significantly extended even in the face of regular use in high tension well access operations.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, reduced stress at the core flange junction may be achieved with additional drum configurations including elongating the core beyond a conventional 35 to 50 inches so as to reduce the total number of well access line layers to be accommodated by the drum. Thus, a 30,000 foot line may be accommodated at the drum with a profile of less than about 30 layers about the core. Furthermore, the foregoing description should not be read as pertaining only to the precise structures described and shown in the accompanying drawings, but rather should be read as consistent with and as support for the following claims, which are to have their fullest and fairest scope.

We claim:

1. A drum for a well access line, the drum comprising:

an inner core having an arcuate portion at an end thereof;

a flange coupled to said inner core at the end forming a core-flange junction; and a collar about said inner core and arcuate portion for accommodating a portion of the well access line thereabout, adjacent said flange, wherein said collar comprises an arcuate edge for physical confrmation to the arcuate portion.

2. The drum of claim 1 wherein the said collar is structurally independent of said flange.

3. The drum of claim 1 wherein said flange and said inner core are of a unitary configuration.

4. The drum of claim 1 wherein said collar comprises at least two collar sections joined together about said inner core.

5. The drum of claim 1 wherein said collar forms a substantially right angle with said flange for the accommodating.

6. The drum of claim 1 wherein said collar is adjacent said flange at the core-flange junction, the drum further comprising:

a groove at the core-flange junction defined by said inner core, said flange, and said collar; and a ductile material insert disposed within said groove.

7. The drum of claim 6 wherein said ductile material insert is replaceable.

8. The drum of claim 1 wherein said inner core and said collar are of an extended configuration so as to allow the drum to accommodate more than about 30,000 feet of the well access line in less than about 30 layers thereof.

9. A drum assembly comprising:

a drum having an inner core with an arcuate portion coupled to a flange and a collar about the inner core and arcuate portion, the collar adjacent the flange;

a well access line having a first portion about the collar; said well access line comprising one of wireline and coiled tubing; and a prime mover coupled to said drum for positioning a second portion of said well access line within a hydrocarbon well.

10. The drum assembly of claim 9 wherein said well access line is wireline and the first portion is coupled to a logging tool.

11. The drum assembly of claim 9 further comprising a mobile skid for accommodating said drum and said prime mover.

12. The drum assembly of claim 11 wherein said mobile skid is configured for placement within a drum truck at an oilfield.

13. A drum assembly comprising:

a drum having an inner core with an arcuate portion coupled to a flange and a collar about the inner core and arcuate portion, the collar adjacent the flange; and a wall adjacent said drum and coupled thereto through at least one bearing, said wall for reinforcement of said drum, the bearing to allow rotating of said drum, wherein said wall is of a trailer housing for an oilfield drum truck.

14. The drum assembly of claim 13 further comprising a well access line having a first portion about the collar and a second portion for positioning within a hydrocarbon well.

15. A drum for accommodating a well access line, the drum comprising:

a core;

a flange substantially perpendicular to said core, a first portion of said flange and said core of non-unitary configuration relative to one another an inner core having an arcuate portion at an end thereof coupled to a second portion of said flange;

a collar about said inner core and arcuate portion for directly accommodating the well access line thereabout, adjacent said flange; and an arm coupling the portion to said core, wherein said arm is configured to provide plastifying resistance to said flange and said core when a well access line is wound about said core.

* * * * *